US008320809B2

(12) United States Patent
Yamanaka et al.

(10) Patent No.: US 8,320,809 B2
(45) Date of Patent: Nov. 27, 2012

(54) CLEANING APPARATUS USING WEB SHEET

(75) Inventors: Takashi Yamanaka, Osaka (JP); Yasunori Minakuchi, Osaka (JP); Kimihide Tsukamoto, Osaka (JP); Shinichi Azumi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 582 days.

(21) Appl. No.: 12/499,496

(22) Filed: Jul. 8, 2009

(65) Prior Publication Data

US 2010/0008704 A1 Jan. 14, 2010

(30) Foreign Application Priority Data

Jul. 14, 2008 (JP) ..... 2008-182861

(51) Int. Cl.
*G03G 15/20* (2006.01)

(52) U.S. Cl. ..... 399/327; 399/326; 399/352

(58) Field of Classification Search ..... 399/326, 399/327, 352
See application file for complete search history.

(56) References Cited

U.S. PATENT DOCUMENTS 6,305,636 B1 * 10/2001 Satoh et al. ..... 242/538.2
7,433,638 B2 10/2008 Ide et al.

FOREIGN PATENT DOCUMENTS

| | | | |
|---|---|---|---|
| JP | 8-185074 | A | 7/1996 |
| JP | 2004-37556 | | 2/2004 |
| JP | 2006-106347 | | 4/2006 |
| JP | 2008-040279 | A | 2/2008 |
| JP | 2008-051887 | A | 3/2008 |

* cited by examiner

*Primary Examiner* — Walter L Lindsay, Jr.
*Assistant Examiner* — Roy Y Yi
(74) *Attorney, Agent, or Firm* — Nixon & Vanderhye P.C.

(57) ABSTRACT

A cleaning apparatus using a web sheet includes: a send-out roller that is wound with the web sheet; a take-up roller that is connected to an end of the web sheet; and a rotation-regulating and canceling portion that regulates rotation of the send-out roller and cancels the regulation according to tension of the web sheet between the send-out roller and the take-up roller; wherein the web sheet is sent out from the send-out roller and taken up by the take-up roller, the web sheet is brought into contact with another roller during the sending out and taking up operation, and extraneous matters that have adhered to the other roller are removed.

5 Claims, 4 Drawing Sheets

CLEANING APPARATUS USING WEB SHEET

BACKGROUND OF THE INVENTION

This application claims priority under 35 U.S.C. §119(a) on Patent Application No. 2008-182861 filed in Japan on Jul. 14, 2008, the entire contents of which are herein incorporated by reference.

The present invention relates to a cleaning apparatus using a web sheet suitable for cleaning, for example, the fixing rollers of a fixing apparatus in an electrographic image-forming apparatus.

Recently, the processing speed of image-forming apparatuses has become higher. For example, the number of sheets that can be printed was 50 to 70 sheets/min (A4 landscape transport) several years ago, but the number has recently increased to 100 to 120 sheets/min (A4 landscape transport), and image-forming apparatuses are becoming used not only in the field of ordinary printing but also in the field of light printing.

In such image-forming apparatuses with higher processing speeds, smears on the fixing rollers in the fixing apparatus increase. The reason for this is that a larger number of sheets that can be printed leads to a larger total amount of toner that adheres to the fixing rollers. Conventionally, toner that has adhered to the fixing rollers is removed using blade cleaning, felt cleaning, or the like. However, in the case where smears on the fixing rollers increase, even if toner that has adhered to the fixing rollers is removed using this sort of method, the toner that has adhered once to a blade or felt may return to the fixing rollers, and, thus, cleaning durability is not sufficient for the period in which the fixing apparatus is used.

Thus, a web cleaning method is proposed as a conventional technique. In the web cleaning method, extraneous matters that have adhered to a fixing roller are removed by winding a web sheet made of a thin fabric onto a send-out roller, connecting an end of this web sheet to a take-up roller, sending out the web sheet from the send-out roller, taking up the web sheet onto the take-up roller and bringing the web sheet into contact with the fixing roller during the sending-out and taking-up operation (see JP 2006-106347A). If the length of the web sheet used is sufficient, the cleaning durability increases.

Here, in the technique described in JP 2006-106347A, rotational driving is controlled separately for the send-out roller and the take-up roller so that the amount of web sheet sent out and taken up is not excessive or insufficient, that is, so that the web sheet does not sag.

However, in the case where rotational driving is controlled separately for the send-out roller and the take-up roller in this manner, the driving mechanism and the control thereof become complex.

Furthermore, in the case where the driving mechanism is shared by the rollers (the send-out roller and the take-up roller) for the sake of simplicity, rotational driving cannot be controlled separately for the rollers, and, thus, the amount of web sheet sent out becomes different from the amount of web sheet taken up. Accordingly, in this case, a tension mechanism or the like for solving sagging of the web sheet has to be provided, and, thus, the structure becomes complex.

In this manner, conventionally, in order to solve sagging of a web sheet, the configuration of the apparatus has become complex.

The present invention was made in view of the above-described conventional problem, and it is an object thereof to provide a cleaning apparatus using a web sheet that can be effectively prevented from sagging with a simple configuration.

SUMMARY OF THE INVENTION

In order to solve the above-described problem, the present invention is directed to a cleaning apparatus using a web sheet, including: a send-out roller that is wound with the web sheet; a take-up roller that is connected to an end of the web sheet; and a rotation-regulating and canceling portion that regulates rotation of the send-out roller and cancels the regulation according to the tension of the web sheet between the send-out roller and the take-up roller; wherein the web sheet is sent out from the send-out roller and taken up by the take-up roller, the web sheet is brought into contact with another roller during the sending out and taking up operation, and extraneous matters that have adhered to the other roller are removed.

According to the present invention, rotation of the send-out roller is regulated and the regulation is canceled according to the tension of the web sheet between the send-out roller and the take-up roller. Thus, the tension of the web sheet can be adjusted. As a result, according to the present invention, sagging of the web sheet can be effectively prevented with a simple configuration.

In the above-described cleaning apparatus, a configuration may be applied in which the rotation-regulating and canceling portion cancels the regulation of rotation of the send-out roller when the tension of the web sheet between the send-out roller and the take-up roller becomes high, and regulates the rotation of the send-out roller when the tension becomes low.

In this case, when the tension of the web sheet becomes high, if regulation of rotation of the send-out roller is cancelled, the web sheet is sent out from the send-out roller, and, thus, the tension of the web sheet decreases. Furthermore, when the tension of the web sheet becomes low, if rotation of the send-out roller is regulated, the web sheet is taken up by the take-up roller in the state where the web sheet is not sent out from the send-out roller, and, thus, the tension of the web sheet increases. As a result, the tension of the web sheet is maintained as appropriate, and sagging of the web sheet is prevented.

In the above-described cleaning apparatus, a configuration may be applied in which the rotation-regulating and canceling portion includes: a gear that is coaxially fixed to the send-out roller; a swing lever provided for a wedge portion that engages with teeth of the gear, that is axially supported in a swingable manner; and a biasing member that rotates the swing lever in one direction; wherein, when the biasing member rotates the swing lever in one direction, the wedge portion of the swing lever engages with the teeth of the gear to stop rotation of the gear and the send-out roller, and the swing lever is pressed against the web sheet between the send-out roller and the take-up roller, and when the tension of the web sheet between the send-out roller and the take-up roller becomes high, the web sheet rotates the swing lever in the opposite direction resisting a biasing force of the biasing member, the wedge portion of the swing lever moves apart from the gear, and rotation of the gear and the send-out roller becomes possible.

In this case, the rotation-regulating and canceling portion includes the gear, the swing lever, and the biasing member. When the biasing member rotates the swing lever in one direction, the wedge portion of the swing lever engages with the teeth of the gear to stop rotation of the gear and the send-out roller, and the swing lever is pressed against the web sheet between the send-out roller and the take-up roller. In this state, the web sheet is taken up by the take-up roller in such a state where the web sheet is not sent out from the send-out roller, and, thus, the tension of the web sheet increases. Furthermore, when the tension of the web sheet between the send-out roller and the take-up roller becomes high, the web sheet rotates the swing lever in the opposite direction resisting a biasing force of the biasing member, the wedge portion of the swing lever moves apart from the gear, and rotation of the gear and the send-out roller becomes possible. According to this configuration, the web sheet is sent out from the send-out roller, and, thus, the tension of the web sheet decreases.

Moreover, the present invention is directed to a fixing apparatus used in an image-forming apparatus, including the above-described cleaning apparatus using the web sheet of the present invention.

Moreover, the present invention is directed to an image-forming apparatus, including the above-described cleaning apparatus using the web sheet of the present invention.

The fixing apparatus and the image-forming apparatus of the present invention employ the above-described cleaning apparatus using the web sheet of the present invention, and, thus, they exhibit the same working effects as the cleaning apparatus using the web sheet.

DESCRIPTION OF THE EMBODIMENTS

Hereinafter, an embodiment of the present invention will be described in detail with reference to the accompanying drawings.

Figure 1:
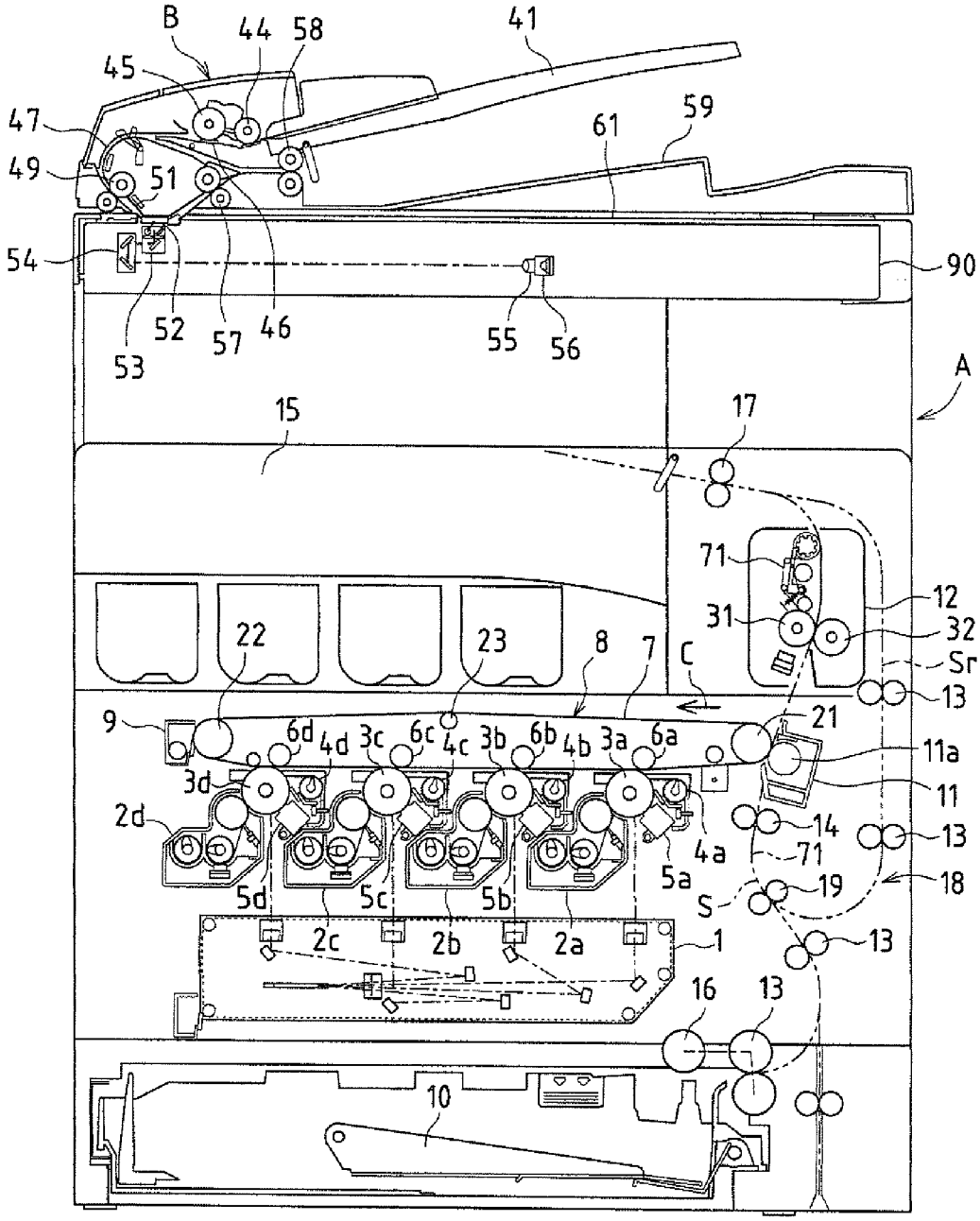
FIG. 1 is a schematic view showing an image-forming apparatus to which an embodiment of the cleaning apparatus of the present invention is applied.

FIG. 1 is a schematic view showing an image-forming apparatus to which an embodiment of the cleaning apparatus of the present invention is applied. As described later, the cleaning apparatus of this embodiment is applied to a fixing apparatus in an image-forming apparatus, and used for removing smears on a hot roller of the fixing apparatus.

First, an image-forming apparatus includes an original-capturing apparatus B that captures an image of an original, and an apparatus main body A that records an image of an original captured by the original-capturing apparatus B or an image received from the outside, in color or in monochrome, on a recording paper.

In the original-capturing apparatus B, when at least one original is set on an original-setting tray 41, a pickup roller 44 is rotated so as to be pressed against the surface of the original, and picks up the original from the tray 41, and the original passes through a gap between a separation roller 45 and a separation pad 46, and is transported to a transport path 47. Here, in the case where there are a plurality of originals, the originals are separated sheet by sheet as they pass through a gap between the separation roller 45 and the separation pad 46, and then each original sheet is transported to the transport path 47.

In the transport path 47, when the leading end of the original is brought into contact with a registration roller 49, the leading end of the original is aligned in parallel to the registration roller 49, and then the original is transported by the registration roller 49 and passes through a gap between a capturing guide 51 and a capturing glass 52. At that time, light from the light source of a first scanning portion 53 is irradiated via the capturing glass 52 on the surface of the original, and light reflected by the surface is incident via the capturing glass 52 on the first scanning portion 53. The reflected light is reflected by mirrors of first and second scanning portions 53 and 54 and guided to an imaging lens 55, and an image of the original is formed by the imaging lens 55 on a CCD (charge coupled device) 56. The CCD 56 captures the image of the original, and outputs image data showing the image of the original. Moreover, the original is transported by transport rollers 57, and discharged by paper discharge rollers 58 onto a paper discharge tray 59.

Furthermore, an original placed on an original stage glass 61 also can be captured. The members, such as the registration roller 49, the capturing guide 51, and the paper discharge tray 59, and other members thereabove are integrated to form a cover member that is pivoted in an openable and closable manner on the rear side of the original-capturing apparatus B. When this upper cover member is opened, the original stage glass 61 is open, and the original can be placed on the original stage glass 61. After the original is placed, when the cover member is closed and capturing of the original is started, while the first and second scanning portions 53 and 54 are moved in the sub-scanning direction, the surface of the original on the original stage glass 61 is exposed to light from the first scanning portion 53, light reflected by the surface of the original is guided by the first and second scanning portions 53 and 54 to the imaging lens 55, and an image of the original is formed by the imaging lens 55 on the CCD 56. At that time, the first and second scanning portions 53 and 54 are moved while maintaining a predetermined relationship in speed, and the position relationship between the first and second scanning portions 53 and 54 is always maintained so that the length of an optical path of the refracted light extending along the surface of the original, the first and second scanning portions 53 and 54, the imaging lens 55, and the CCD 56 in this order does not change, and, thus, the image of the original is always kept accurately focused on the CCD 56.

The entire image of the original that has been captured in this manner is sent as image data to the apparatus main body A of the image-forming apparatus, and the image is recorded on a recording paper in the apparatus main body A.

Conversely, the apparatus main body A of the image-forming apparatus includes a laser exposing apparatus 1, a development apparatus 2, a photosensitive drum 3, a charging unit 5, a cleaner apparatus 4, an intermediate transfer belt apparatus 8, a fixing apparatus 12, a paper-transporting apparatus 18, a paper feed tray 10, a paper discharge tray 15, and the like.

Image data processed in the image-forming apparatus corresponds to a color image using colors consisting of black (K), cyan (C), magenta (M), and yellow (Y), or corresponds to a monochrome image using a monochrome color (e.g., black). Thus, four development apparatuses 2 (2*a*, 2*b*, 2*c*, and 2*d*), four photosensitive drums 3 (3*a*, 3*b*, 3*c*, and 3*d*), four charging units 5 (5*a*, 5*b*, 5*c*, and 5*d*), and four cleaner apparatuses 4 (4*a*, 4*b*, 4*c*, and 4*d*) are provided so that four types of latent images corresponding to the respective colors are formed. Here, in FIG. 1, the symbol a corresponds to black, b to cyan, c to magenta, and d to yellow, and four image stations are formed.

The photosensitive drums 3 are disposed substantially in the center of the apparatus main body A.

The charging units 5 are charging portions that uniformly charge the surface of the photosensitive drums 3 to a predetermined potential. As the charging units 5, a contact-type charging unit using a roller or brush, or a charger-type charging unit is used.

The laser exposing apparatus 1 is a laser scanning unit (LSU) including laser diodes and reflecting mirrors, and causes the charged surface of the photosensitive drums 3 to be exposed to light according to image data to form electrostatic latent images according to the image data on the surface.

The development apparatus 2 develops the electrostatic latent images formed on the photosensitive drums 3 with toners (K, C, M, Y). The cleaner apparatuses 4 remove and recover toner remaining on the surface of the photosensitive drums 3 after development and image transfer.

The intermediate transfer belt apparatus 8 disposed above the photosensitive drums 3 includes an intermediate transfer belt 7, an intermediate transfer belt-driving roller 21, an idler roller 22, intermediate transfer rollers 6 (6*a*, 6*b*, 6*c*, and 6*d*), and an intermediate transfer belt-cleaning apparatus 9.

The intermediate transfer belt-driving roller 21, the intermediate transfer rollers 6, the idler roller 22, and the like support the intermediate transfer belt 7 in a tensioned state, and circumferentially move the intermediate transfer belt 7 in the direction of arrow C.

The intermediate transfer rollers 6 are supported in a rotatable manner near the intermediate transfer belt 7, and pressed via the intermediate transfer belt 7 against the photosensitive drums 3. A transfer bias for transferring the toner images on the photosensitive drums 3 to the intermediate transfer belt 7 is applied to the intermediate transfer rollers 6.

The intermediate transfer belt 7 is arranged so as to be in contact with the photosensitive drums 3*a*, 3*b*, 3*c*, and 3*d*. The toner images on the surfaces of the photosensitive drums 3*a*, 3*b*, 3*c*, and 3*d* are sequentially transferred to the intermediate transfer belt 7 and superimposed, and, thus, a color toner image (toner images of respective colors) is formed. This transfer belt is formed as an endless belt using a film having a thickness of approximately 100 to 150 μm.

The toner images are transferred from the photosensitive drums 3 to the intermediate transfer belt 7, using the intermediate transfer rollers 6 pressed against the back face of the intermediate transfer belt 7. In order to transfer the toner images, a high-voltage transfer bias (a high voltage of the opposite polarity (+) to the charge polarity (−) of the toner) is applied to the intermediate transfer rollers 6. The intermediate transfer rollers 6 are rollers including a base that is made of a metal shaft (e.g., stainless steel) having a diameter of 8 to 10 mm, and an electrically conductive elastic material (e.g., EPDM, urethane foam, etc.) that covers the surface of the shaft. The electrically conductive elastic material enables a high voltage to be uniformly applied to a recording paper.

In this manner, the toner images on the surfaces of the photosensitive drums 3*a*, 3*b*, 3*c*, and 3*d* are superimposed on the intermediate transfer belt 7 to form the color toner image represented by the image data. The thus superimposed toner images of respective colors are transported together with the intermediate transfer belt 7 in the direction of arrow C, and transferred to a recording paper by a secondary transfer apparatus 11 that is in contact with the intermediate transfer belt 7.

The intermediate transfer belt-driving roller 21 and a transfer roller 11*a* of the secondary transfer apparatus 11 are pressed against each other via the intermediate transfer belt 7, and a nip region is formed by this pressing. Furthermore, a voltage (a high voltage of the opposite polarity (+) to the charge polarity (−) of the toner) for transferring toner images of respective colors on the intermediate transfer belt 7 to a recording paper is applied to the transfer roller 11*a* of the secondary transfer apparatus 11. In order to constantly maintain the nip region, one of the transfer roller 11*a* of the secondary transfer apparatus 11 and the intermediate transfer belt-driving roller 21 is made of a hard material (metal, etc.), and the other is made of a soft material such as an elastic roller (an elastic rubber roller, a foamable resin roller, etc.).

The toner images on the intermediate transfer belt 7 may not be completely transferred by the secondary transfer apparatus 11 to a recording paper, and toner may remain on the intermediate transfer belt 7. This adhered toner causes toner color mixing in the following step. Thus, adhered toner is removed and recovered by the intermediate transfer belt-cleaning apparatus 9. The intermediate transfer belt-cleaning apparatus 9 includes, for example, a cleaning blade that is in contact with the intermediate transfer belt 7 as a cleaning member, and the back side of the intermediate transfer belt 7 is supported by the idler roller 22 at a position where the cleaning blade is in contact with the intermediate transfer belt 7.

The paper feed tray 10 is a tray in which recording papers are stored, and is disposed below an image-forming portion of the apparatus main body A. Furthermore, the paper discharge tray 15 disposed above the image-forming portion is a tray for placing a printed recording paper facedown.

Furthermore, the apparatus main body A includes the paper-transporting apparatus 18 for transporting a recording paper in the paper feed tray 10 via the secondary transfer apparatus 11 and the fixing apparatus 12 to the paper discharge tray 15. The paper-transporting apparatus 18 has an S-shaped paper transport path S, and a pickup roller 16, registration rollers 14, the fixing apparatus 12, transport rollers 13, paper discharge rollers 17, and the like are arranged along the paper transport path S.

The pickup roller 16 is a draw-in roller that is disposed at an end portion of the paper feed tray 10 and feeds recording papers sheet by sheet from the paper feed tray 10 to the paper transport path S. The transport rollers 13 are small rollers for assisting in the transportation of the recording paper, and arranged at a plurality of positions along the paper transport path S.

The registration rollers 14 stops the transported recording paper once, aligns the leading end of the recording paper, and transports the recording paper in time according to the rotation of the photosensitive drums 3 and the intermediate transfer belt 7 so that the color toner image on the intermediate transfer belt 7 is transferred to the recording paper in the nip region between the intermediate transfer belt 7 and the secondary transfer apparatus 11 (more specifically, in a region between the intermediate transfer belt-driving roller 21 and the transfer roller 11*a* of the secondary transfer apparatus 11 having the intermediate transfer belt 7 therebetween).

The fixing apparatus 12 receives the recording paper to which the toner image has been transferred, and transports the recording paper so that the recording paper is nipped in the nip region between a hot roller 31 and a pressure roller 32.

The recording paper to which the toner images of respective colors have been fixed is discharged by the paper discharge rollers 17 onto the paper discharge tray 15.

Here, a monochrome image can be formed using only the image-forming station denoted by the symbol a in FIG. 1, and transferred to the intermediate transfer belt 7 of the intermediate transfer belt apparatus 8. This monochrome image is also transferred from the intermediate transfer belt 7 to a recording paper and fixed onto the recording paper as in the case of the color image.

Furthermore, in the case where printing is performed not only on one surface of a recording paper but also on both surfaces, after an image on the surface of the recording paper is fixed by the fixing apparatus 12, the paper discharge rollers 17 are stopped and then rotated in the opposite direction during transportation of the recording paper using the paper discharge rollers 17 on the paper transport path S, the recording paper is passed through a reverse path Sr where the recording paper is turned over, and then the recording paper is guided to the registration rollers 14. Subsequently, as in the case of the surface of the recording paper, an image is transferred and fixed to the back face of the recording paper, and the recording paper is discharged onto the paper discharge tray 15.

Next, the fixing apparatus 12 will be described in more detail. In the fixing apparatus 12, when the speed at which the recording paper is transported or the speed at which an image is formed on the recording paper becomes high, sufficient heat tends not to be applied to the recording paper that passes through the nip region between the hot roller 31 and the pressure roller 32, or the surface temperature of the rollers 31 and 32 (the hot roller 31 and the pressure roller 32) tends to be lowered. When this situation is left without any countermeasure, failure in the fixing of the toner image on the recording paper occurs. Thus, a heater is accommodated in each of the rollers 31 and 32, and heats the rollers 31 and 32.

Furthermore, when the speed at which the recording paper is transported or the speed at which an image is formed on the recording paper increases, the amount of toner that adheres to the surface of the hot roller 31 increases, and smears on the hot roller 31 become severe (increase). Accordingly, a cleaning apparatus 71 of this embodiment that cleans the hot roller 31 using a web sheet is applied.

Figure 2:
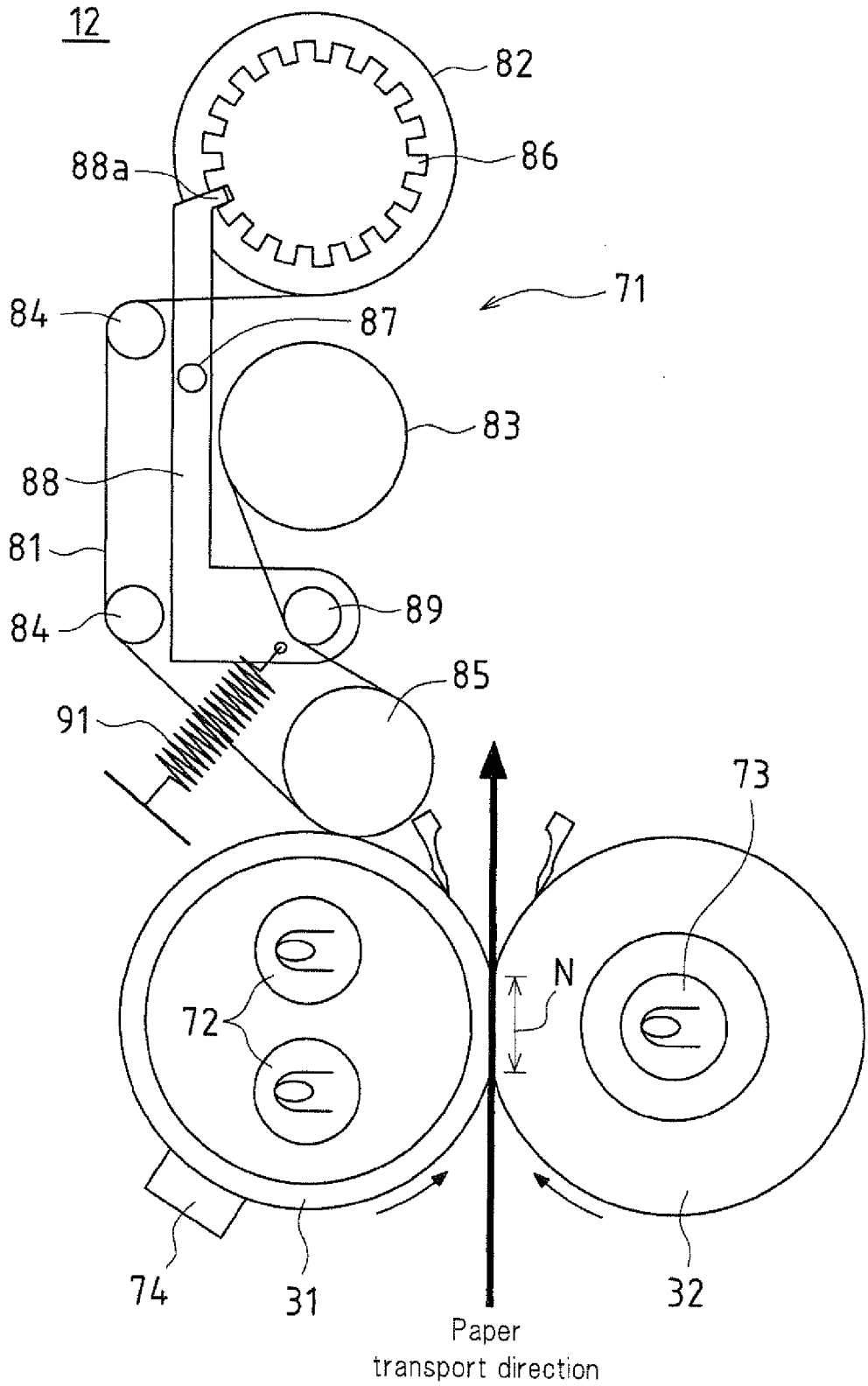
FIG. 2 is a cross-sectional view schematically showing a fixing apparatus in the image-forming apparatus in FIG. 1 as seen from the side.

FIG. 2 is a cross-sectional view schematically showing the fixing apparatus 12 as seen from the side. The fixing apparatus 12 includes the hot roller 31, the pressure roller 32, and the cleaning apparatus 71 of this embodiment.

The rollers 31 and 32 are pressed against each other at a predetermined pressure (e.g., 600 N) to form a nip region N therebetween. The length of the nip region N (the length in their rotational direction of the rollers 31 and 32) is set to, for example, 9 mm. The rollers 31 and 32 rotate while being heated to a prescribed fixing temperature (e.g., 180° C.), and heat and melt a toner image on a recording paper P that passes through the nip region N.

The hot roller 31 is a three-layered roller consisting of a metal core, an elastic layer that is disposed on the outer circumferential face of the metal core, and a releasing layer that is disposed on the outer circumferential face of the elastic layer. As the metal core, for example, a metal, such as steel, stainless steel, aluminum, or copper, or their alloy is used. As the elastic layer, silicone rubber is used. As the releasing layer, a fluororesin, such as PFA (a copolymer of tetrafluoroethylene and perfluoro(alkyl vinyl ether)) or PTFE (polytetrafluoroethylene) is used.

A heater lamp (halogen lamp) 72 as a heat source that heats the hot roller 31 is disposed inside the hot roller 31 (inside the metal core).

As in the case of the hot roller 31, the pressure roller 32 is also a three-layered roller consisting of: a metal core made of a metal, such as steel, stainless steel, aluminum, or copper, their alloys, or the like; an elastic layer made of silicone rubber or the like that is disposed on the surface of the metal core; and a releasing layer made of PFA, PTFE, or the like that is disposed on the elastic layer.

Also, a heater lamp 73 that heats the pressure roller 32 is disposed inside the pressure roller 32 (inside the metal core).

The on/off of the heater lamps 72 and 73 of the rollers 31 and 32 is controlled. When the lamps are on, infrared rays are emitted to heat the rollers 31 and 32. The rollers 31 and 32 are heated from the inside, and the surface is uniformly heated.

A thermistor 74 is disposed near the circumferential face of the hot roller 31, and detects the surface temperature of the hot roller 31.

Based on the surface temperature of the hot roller 31 detected by the thermistor 74, the on/off of the heater lamps 72 and 73 of the hot roller 31 and the pressure roller 32 is controlled, and the surface temperature of the hot roller 31 and the pressure roller 32 is adjusted. Accordingly, the surface temperature of the rollers 31 and 32 is precisely controlled, and a toner image on a recording paper can be reliably fixed.

Meanwhile, the cleaning apparatus 71 of this embodiment uses a web sheet to effectively clean toner that has adhered to the hot roller 31.

The cleaning apparatus 71 includes a send-out roller 82 that is wound with a web sheet 81 made of a thin fabric (having a thickness of approximately 100 μm) immersed in an oil (silicone oil), a take-up roller 83 that is connected to an end of the web sheet 81, a plurality of support rollers 84 on which the web sheet 81 sent out from the send-out roller 82 is extended, and a pressing roller 85 that presses the web sheet 81 against the hot roller 31 between the send-out roller 82 and the take-up roller 83. The pressing roller 85 presses the web sheet 81 against the surface of the hot roller 31, and wipes off adhered toner that has adhered to the surface of the hot roller 31.

The web sheet 81 is pressed against the surface of the hot roller 31 in the nip region between the pressing roller 85 and the hot roller 31, and toner that has adhered to the surface of the hot roller 31 is removed in the nip region. When a portion of the web sheet 81 in the nip region becomes smeared by toner that has adhered to the surface of the hot roller 31, and removal of adhered toner with the portion of the web sheet 81 becomes difficult, the take-up roller 83 is rotationally driven by a constant amount, and the take-up roller 83 takes up a constant length of the web sheet 81. Accordingly, the send-out roller 82 is driven as a follower, the web sheet 81 is sent out from the send-out roller 82, a new portion of the web sheet 81 in the nip region is provided, and the new portion of the web sheet 81 can remove adhered toner.

Furthermore, each time a constant amount of toner is consumed, it is regarded that removal of adhered toner with the portion of the web sheet 81 in the nip region becomes difficult. Thus, the take-up roller 83 is rotationally driven by a constant amount, the send-out roller 82 is driven as a follower, and a new portion of the web sheet 81 in the nip region is provided.

Here, when the web sheet 81 is sent out from the send-out roller 82 to the take-up roller 83, if the web sheet 81 sags, creases or an excessive load occurs on the web sheet 81, and the web sheet is broken or meanders.

Thus, the cleaning apparatus 71 of this embodiment includes a rotation-regulating and canceling portion that regulates rotation of the send-out roller 82 and cancels the regulation according to the tension of the web sheet 81 between the send-out roller 82 and the take-up roller 83, a gear 86 that is coaxially fixed to the send-out roller 82, a swing lever 88 that is axially supported at a position near the center in a swingable manner by a shaft 87, a tension roller 89 that is axially supported on one end side (hereinafter, referred to as a "first end side") of the swing lever 88, and a coiled spring 91 (a biasing member in the present invention) that is connected on the first end side of the swing lever 88 and biases the swing lever 88 clockwise about the shaft 87 (using the shaft 87 as an axis). Accordingly, sagging of the web sheet 81 is prevented. Here, the rotation-regulating and canceling portion includes the gear 86, the swing lever 88, and the coiled spring 91, and regulates rotation of the send-out roller 82 and cancels the regulation according to the tension of the web sheet 81 between the send-out roller 82 and the take-up roller 83.

Figure 3:
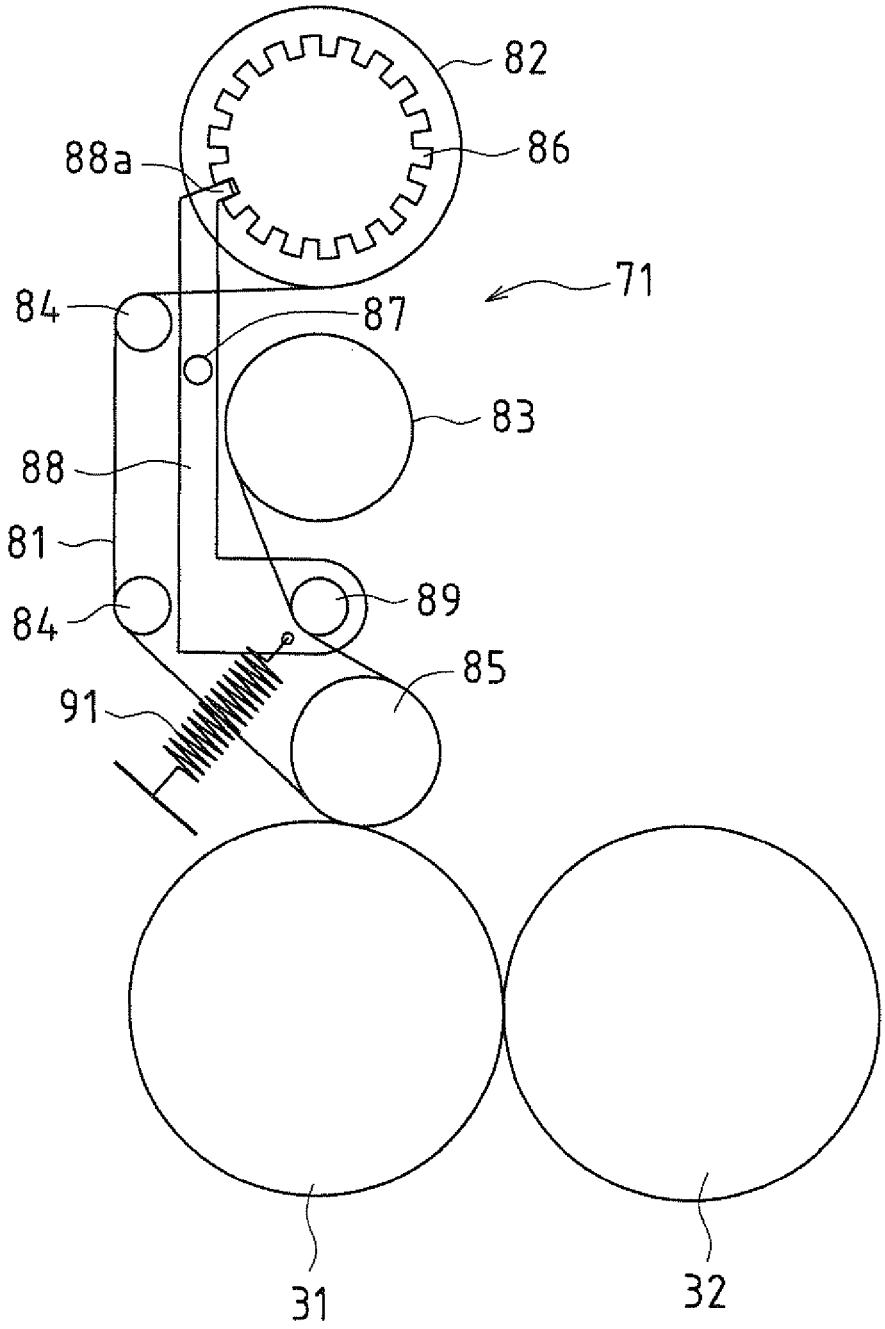
FIG. 3 is a side view showing an operation state of the cleaning apparatus of this embodiment.

As shown in FIG. 3, when the take-up roller 83 is stopped and the web sheet 81 is not sent out from the send-out roller 82 to the take-up roller 83, the coiled spring 91 biases the swing lever 88 clockwise about the shaft 87, and the tension roller 89 on the first end side of the swing lever 88 is pressed against the web sheet 81. Simultaneously, the swing lever 88 rotates clockwise about the shaft 87, a wedge portion 88*a* on the other end side (hereinafter, referred to as a "second end side") of the swing lever 88 engages with the teeth of the gear 86 of the send-out roller 82, and the rotation of the gear 86 and the send-out roller 82 is prohibited (regulated).

In the state where the rotation of the send-out roller 82 is prohibited, the web sheet 81 is not sent out from the send-out roller 82, and, thus, the web sheet 81 is curved by the pressing of the tension roller 89 on the first end side of the swing lever 88. Thus, a constant tension is applied to the web sheet 81, and sagging of the web sheet 81 is solved.

Figure 4:
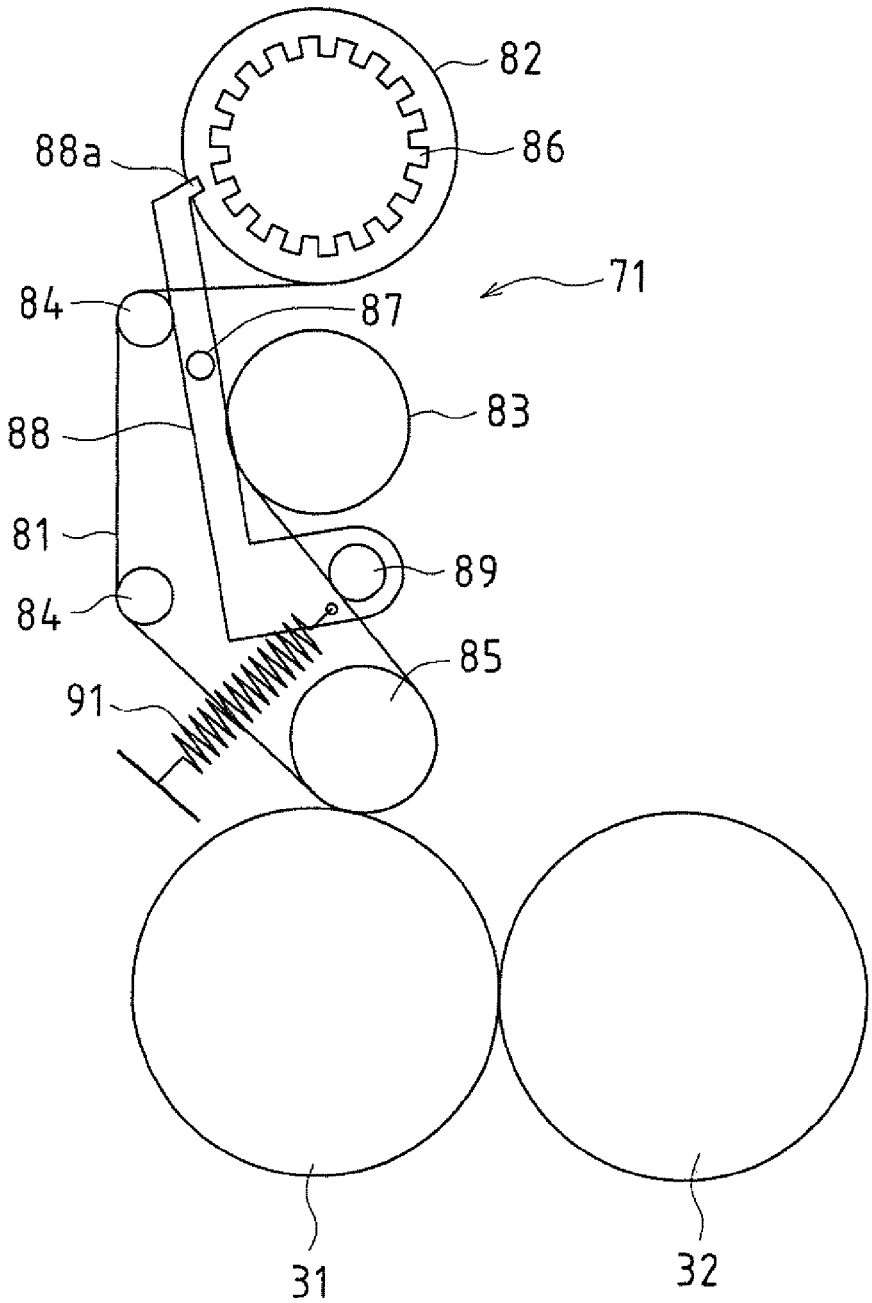
FIG. 4 is a side view showing another operation state of the cleaning apparatus in FIG. 3.

Next, when the take-up roller 83 is rotationally driven, and the taking up of the web sheet 81 by the take-up roller 83 is started, the rotation of the gear 86 and the send-out roller 82 is prohibited by the wedge portion 88*a* on the second end side of the swing lever 88 immediately after starting to take up, and, thus, the web sheet 81 is not sent out from the send-out roller 82, and the tension of the web sheet 81 gradually increases. Thus, as shown in FIG. 4, the web sheet 81 linearly extends resisting the biasing force of the coiled spring 91 acting on the tension roller 89 on the first end side of the swing lever 88, and the web sheet 81 presses against the tension roller 89 on the first end side of the swing lever 88, thus moving it. The swing lever 88 rotates counterclockwise about the shaft 87, the wedge portion 88*a* on the second end side of the swing lever 88 disengages from (moves apart from) the teeth of the gear 86, and the rotation of the gear 86 and the send-out roller 82 becomes possible (the regulation of the rotation of the send-out roller 82 is cancelled). Accordingly, the web sheet 81 is sent out from the send-out roller 82, and the send-out roller 82 is driven as a follower.

Subsequently, when the take-up roller 83 takes up a constant length of the web sheet 81, the take-up roller 83 is stopped. Immediately after the take-up roller 83 is stopped, the tension of the web sheet 81 is high, and the wedge portion 88*a* on the second end side of the swing lever 88 is still disengaged from the teeth of the gear 86 as shown in FIG. 4. Then, when the web sheet 81 is sent out from the send-out roller 82, the tension of the web sheet 81 decreases according to the sending out of the web sheet 81, the force of the web sheet 81 pressing the tension roller 89 on the first end side of the swing lever 88 is reduced, the swing lever 88 rotates clockwise about the shaft 87 due to the biasing force of the coiled spring 91 as shown in FIG. 3, and the wedge portion 88*a* on the second end side of the swing lever 88 engages with the teeth of the gear 86. Accordingly, the rotation of the send-out roller 82 is prohibited (regulated), and the web sheet 81 is curved by the pressing of the tension roller 89 on the first end side of the swing lever 88. Thus, a constant tension is applied to the web sheet 81, and sagging of the web sheet 81 is solved.

Subsequently, each time the take-up roller 83 takes up a constant length of the web sheet 81, the operation states in FIGS. 3 and 4 are alternately repeated, and the web sheet 81 is sent out without sagging.

In this manner, in the cleaning apparatus 71 of this embodiment, each time the take-up roller 83 takes up a constant length of the web sheet 81, when the tension of the web sheet 81 increases, the swing lever 88 rotates counterclockwise, prohibition of the rotation (regulation of the rotation) of the send-out roller 82 by the swing lever 88 is canceled, and the send-out roller 82 is driven as a follower. Furthermore, when the tension of the web sheet 81 decreases, the swing lever 88 rotates clockwise, the rotation of the send-out roller 82 is prohibited by the swing lever 88, and the tension roller 89 on the first end side of the swing lever 88 is pressed against the web sheet 81. Thus, the web sheet 81 does not sag.

Note that the present invention is not limited to the foregoing embodiment, and may be varied in many ways. For example, the cleaning apparatus of the present invention may be used for removing smears on not only the hot roller of the fixing apparatus but also the pressure roller or rollers of other apparatuses.

The present invention may be embodied in various other forms without departing from the spirit, gist, or essential characteristics thereof. The embodiments disclosed in this application are to be considered in all respects as illustrative and not limiting. The scope of the invention is indicated by the appended claims rather than by the foregoing description. All variations and modifications falling within the equivalency range of the appended claims are intended to be embraced therein.

What is claimed is:

1. A cleaning apparatus using a web sheet, comprising:

a send-out roller that is wound with the web sheet;

a take-up roller that is connected to an end of the web sheet; and a rotation-regulating and canceling portion that regulates rotation of the send-out roller and cancels the regulation according to tension of the web sheet between the send-out roller and the take-up roller;

wherein the web sheet is sent out from the send-out roller and taken up by the take-up roller, the web sheet is brought into contact with another roller during the sending out and taking up operation, and extraneous matters that have adhered to the other roller are removed.

2. The cleaning apparatus using the web sheet according to claim 1, wherein the rotation-regulating and canceling portion cancels the regulation of rotation of the send-out roller when the tension of the web sheet between the send-out roller and the take-up roller becomes high, and regulates the rotation of the send-out roller when the tension becomes low.

3. The cleaning apparatus using the web sheet according to claim 1, wherein the rotation-regulating and canceling portion comprises: a gear that is coaxially fixed to the send-out roller; a swing lever provided for a wedge portion that engages with teeth of the gear, that is axially supported in a swingable manner; and a biasing member that rotates the swing lever in one direction;

wherein, when the biasing member rotates the swing lever in one direction, the wedge portion of the swing lever engages with the teeth of the gear to stop rotation of the gear and the send-out roller, and the swing lever is pressed against the web sheet between the send-out roller and the take-up roller, and when the tension of the web sheet between the send-out roller and the take-up roller becomes high, the web sheet rotates the swing lever in the opposite direction resisting a biasing force of the biasing member, the wedge portion of the swing lever moves apart from the gear, and rotation of the gear and the send-out roller becomes possible.

4. A fixing apparatus used in an image-forming apparatus, comprising the cleaning apparatus using the web sheet according to claim 1.

5. An image-forming apparatus, comprising the cleaning apparatus using the web sheet according to claim 1.

* * * * *